US007187328B2

(12) United States Patent
Tanaka et al.

(10) Patent No.: US 7,187,328 B2
(45) Date of Patent: Mar. 6, 2007

(54) ANTENNA DEVICE

(75) Inventors: Masato Tanaka, Tokyo (JP); Jae-Hyeuk Jang, Tokyo (JP); Young-Sik Kim, Seoul (KR); Byung Sun Park, Seoul (KR)

(73) Assignee: National Institute of Information and Communications Technology, Incorporated Administrative Agency, Tokyo (JP)

( * ) Notice: Subject to any disclaimer, the term of this patent is extended or adjusted under 35 U.S.C. 154(b) by 0 days.

(21) Appl. No.: 10/532,298

(22) PCT Filed: Oct. 25, 2002

(86) PCT No.: PCT/JP02/11131

§ 371 (c)(1),
(2), (4) Date: Jan. 3, 2006

(87) PCT Pub. No.: WO2004/038862

PCT Pub. Date: May 6, 2004

(65) Prior Publication Data

US 2006/0139209 A1 Jun. 29, 2006

(51) Int. Cl.
*H01Q 1/38* (2006.01)

(52) U.S. Cl. ..... 343/700 MS; 343/789

(58) Field of Classification Search ..... 343/700 MS, 343/846, 786, 789

See application file for complete search history.

(56) References Cited

U.S. PATENT DOCUMENTS

| | | | | |
|---|---|---|---|---|
| 4,660,048 | A * | 4/1987 | Doyle | 343/700 MS |
| 4,878,060 | A | 10/1989 | Barbier et al. | 343/778 |
| 5,889,498 | A | 3/1999 | Lange et al. | 343/840 |
| 5,977,710 | A * | 11/1999 | Kuramoto et al. | 343/700 MS |
| 6,593,887 | B2 * | 7/2003 | Luk et al. | 343/700 MS |
| 6,891,513 | B2 * | 5/2005 | Kienzle et al. | 343/786 |
| 2002/0044099 | A1 * | 4/2002 | Yamamoto et al. | 343/789 |
| 2002/0047805 | A1 * | 4/2002 | Yamamoto et al. | 343/700 MS |
| 2003/0052825 | A1 * | 3/2003 | Rao et al. | 343/700 MS |
| 2003/0184479 | A1 * | 10/2003 | Collins | 343/700 MS |

FOREIGN PATENT DOCUMENTS

| | | |
|---|---|---|
| EP | 0 858 126 A2 | 8/1998 |
| JP | 62-118613 A | 5/1987 |

(Continued)

OTHER PUBLICATIONS

Rexberg et al., "Feed arary element for mobile communication service systems," Digest of the Antennas and Propagation Society Intenational Symposium, Seattle, WA, vol. 3, Jun. 20, 1994, pp. 902-905.

*Primary Examiner*—Hoang V. Nguyen
*Assistant Examiner*—Tung Le
(74) *Attorney, Agent, or Firm*—Birch, Stewart, Kolasch & Birch, LLP

(57) ABSTRACT

In an antenna device having a substantially conical conductive member, having upper and lower sides made open, erected in a substantially vertical direction around a substantially circular microstrip patch provided on the upper side of a substantially circular substrate, the lower opening portion of the conductive member is grounded to a ground plate provided on the lower side of the substrate, and the diameter of the upper opening portion of the conductive member is larger than the diameter of the lower opening portion of the conductive member.

6 Claims, 9 Drawing Sheets

FOREIGN PATENT DOCUMENTS

| | | | |
|---|---|---|---|
| JP | 5-206721 | A | 8/1993 |
| JP | 7-297625 | A | 11/1995 |
| JP | 7-326921 | A | 12/1995 |
| JP | 10-242745 | A | 9/1998 |
| JP | 3026171 | B2 | 1/2000 |
| JP | 2001-168632 | | 6/2001 |

* cited by examiner

FIG. 6

GAIN (dBi) WHEN THE DIAMETER (D) OF A SUBSTRATE AND THE SPREAD DIAMETER (d) OF A CONDUCTIVE MEMBER ARE CHANGED

| D(mm) \ d(mm) | 0 | 5 | 10 | 15 | 20 | 25 | 30 | 35 | 40 | 45 | 50 |
|---|---|---|---|---|---|---|---|---|---|---|---|
| 80mm | 7.7 | 8.6 | 9.0 | 9.8 | 10.1 | 10.7 | 11.1 | 11.4 | 11.7 | 11.8 | 11.7 |
| 90mm | 8.5 | 9.2 | 9.4 | 10.1 | 10.5 | 11.2 | 11.5 | 11.7 | 12.0 | 12.1 | 11.7 |
| 100mm | 9.2 | 9.5 | 10.0 | 10.5 | 11.2 | 11.4 | 11.9 | 12.2 | 12.2 | 12.1 | 11.9 |
| 110mm | 9.7 | 10.2 | 10.5 | 11.1 | 11.7 | 12.1 | 12.3 | 12.5 | 12.2 | 12.1 | 11.7 |
| 120mm | 10.3 | 10.9 | 11.3 | 11.9 | 12.2 | 12.4 | 12.7 | 12.2 | 11.9 | 11.4 | 11.2 |
| 130mm | 10.9 | 11.5 | 11.8 | 12.3 | 12.4 | 12.2 | 11.7 | 11.3 | 10.9 | 10.7 | 10.6 |
| 140mm | 11.6 | 12.1 | 12.2 | 11.8 | 11.0 | 10.6 | 10.0 | 10.1 | 10.2 | 10.1 | 9.8 |
| 150mm | 10.9 | 10.5 | 9.4 | 8.9 | 9.2 | 9.4 | 9.4 | 9.8 | 9.4 | 9.2 | 9.1 |

(HEIGHT (H) OF A CONDUCTIVE MEMBER FIXED AT 1/3 A WAVELENGTH)

FIG. 7

BEAM WIDTH (DEGREE) WHEN THE DIAMETER (D) OF A SUBSTRATE AND THE SPREAD DIAMETER (d) OF A CONDUCTIVE MEMBER ARE CHANGED

| D(mm) \ d(mm) | | 0 | 5 | 10 | 15 | 20 | 25 | 30 | 35 | 40 | 45 | 50 |
|---|---|---|---|---|---|---|---|---|---|---|---|---|
| 80mm | H PLANE | 75 | 73 | 66 | 67 | 65 | 63 | 58 | 56 | 54 | 53 | 52 |
| | E PLANE | 73 | 65 | 48 | 60 | 57 | 53 | 51 | 48 | 46 | 43 | 44 |
| 90mm | H PLANE | 69 | 69 | 73 | 65 | 63 | 57 | 55 | 54 | 53 | 50 | 51 |
| | E PLANE | 68 | 62 | 64 | 58 | 54 | 51 | 49 | 47 | 43 | 40 | 40 |
| 100mm | H PLANE | 65 | 68 | 64 | 62 | 57 | 57 | 54 | 51 | 51 | 48 | 46 |
| | E PLANE | 62 | 61 | 59 | 55 | 51 | 49 | 44 | 42 | 39 | 38 | 38 |
| 110mm | H PLANE | 64 | 62 | 61 | 58 | 56 | 52 | 51 | 48 | 46 | 44 | 43 |
| | E PLANE | 58 | 57 | 54 | 51 | 45 | 42 | 40 | 37 | 37 | 35 | 38 |
| 120mm | H PLANE | 61 | 59 | 57 | 53 | 52 | 50 | 46 | 45 | 45 | 45 | 41 |
| | E PLANE | 54 | 53 | 47 | 44 | 43 | 37 | 35 | 34 | 34 | 37 | 43 |
| 130mm | H PLANE | 58 | 56 | 54 | 52 | 48 | 45 | 45 | 45 | 41 | 43 | 40 |
| | E PLANE | 48 | 47 | 44 | 40 | 35 | 33 | 32 | 34 | 39 | 53 | 58 |
| 140mm | H PLANE | 51 | 49 | 48 | 47 | 46 | 42 | 46 | 43 | 42 | 42 | 42 |
| | E PLANE | 42 | 39 | 36 | 33 | 33 | 35 | 44 | 52 | 67 | 72 | 88 |
| 150mm | H PLANE | 49 | 46 | 46 | 46 | 43 | 44 | 43 | 42 | 43 | 43 | 45 |
| | E PLANE | 36 | 30 | 30 | 40 | 49 | 97 | 103 | 82 | 97 | 97 | 97 |

(HEIGHT (H) OF A CONDUCTIVE MEMBER FIXED AT 1/3 A WAVELENGTH)

ANTENNA DEVICE

This application is a 371 of PCT/JP02/11131 Oct. 25, 2002.

TECHNICAL FIELD

The present invention relates to an antenna device using a microstrip patch and more particularly to an antenna device in which a substantially conical cup is provided around a microstrip patch.

BACKGROUND ART

An applicant of the present invention has a patent right of an antenna device, in which a substantially conductive member is provided around a microstrip antenna, in Japan (Japanese Patent No. 3026171.

In the antenna device of Japanese Patent No. 3026171, it is intended to improve gain and to realize a narrower beam width (here, a beam width represents a half-power width), when compared with the case where a substantially cylindrical conductive member is not provided around a microstrip antenna.

More concretely, whereas although the gain of the conventional microstrip antenna is about 7 dBi, in the above-mentioned antenna device, it is intended to increase gain and to realize a narrower beam width such that a substantially cylindrical conductive member is provided around a microstrip antenna in contrast to an conventional microstrip antenna characterized in that the thickness of the antenna is small, that the antenna is light, that the structure of the antenna is simple, and that a circularly polarized wave can be easily obtained. As a result, although dependent on the height and diameter of a substantially cylindrical conductive member, for example, an antenna device having a gain of about 9 dBi or more and a beam width of about 50 degrees can be obtained.

It is an object of the present invention to provide an antenna device having a high gain and/or a narrow beam width such that an antenna device shown in Japanese patent No. 3026171 is improved.

DISCLOSURE OF INVENTION

In order to attain the above object, an antenna device of the present invention has the following structure.

That is, the antenna device is characterized in that a substantially conical conductive member, having upper and lower sides made open, is erected in a substantially vertical direction around a substantially circular microstrip patch provided on the upper side of a substantially circular substrate, that the lower opening portion of the conductive member is grounded to a ground plate provided on the lower side of the substrate, and that the diameter of the upper opening portion of the conductive member is larger than the diameter of the lower opening portion of the conductive member.

It becomes able to realize a higher gain and/or a narrower beam width such that, to a wavelength of a signal wave serving as an object of the antenna, the height of the conductive member is from about ⅓ a wavelength to about ½ a wavelength.

Furthermore, it becomes able to realize a higher gain and/or a narrower beam width than in an antenna device of the above Japanese Patent No. 3026171 such that, to a wavelength of a signal wave serving as an object of an antenna device, the height of the conductive member is about ⅓ a wavelength, the diameter of the substrate is from about ¾ a wavelength to about ⅝ a wavelength, and the diameter of the upper opening portion of the conductive member is from about 13/12 a wavelength to about 11/6 a wavelength.

In particular, an extra high gain and an extra narrow beam width can be made compatible such that, while the diameter of the substrate is about a wavelength, the height of the conductive member is made about ⅓ a wavelength and the diameter of the upper opening portion of the conductive member is made about 3/2 a wavelength.

In addition to a high gain and a narrow beam width, the bandwidth of an antenna device can be increased such that the substrate is formed by using a honeycomb material and/or a parasitic microstrip patch is provided in the front of the radiation surface of the microstrip patch.

The conductive member may be freely changed around the microstrip patch. In this way, without changing the ground plate, the substrate, and the microstrip patch, an antenna device having a gain and beam width for desired purposes can be constituted such that the conductive member is changed.

BRIEF DESCRIPTION OF THE DRAWINGS

FIG. 6 shows the change of gain (computation value) when the diameter of a substrate and the diameter of the upper opening portion of a substantially cylindrical conductive member are changed while the height of the conductive member is fixed at ⅓ a wavelength.

FIG. 7 shows the change of a beam width (computation value) when the diameter of a substrate and the diameter of the upper opening portion of a substantially cylindrical conductive member are changed while the height of the conductive member is fixed at ⅓ a wavelength.

REFERENCE NUMERALS

Figure 1:
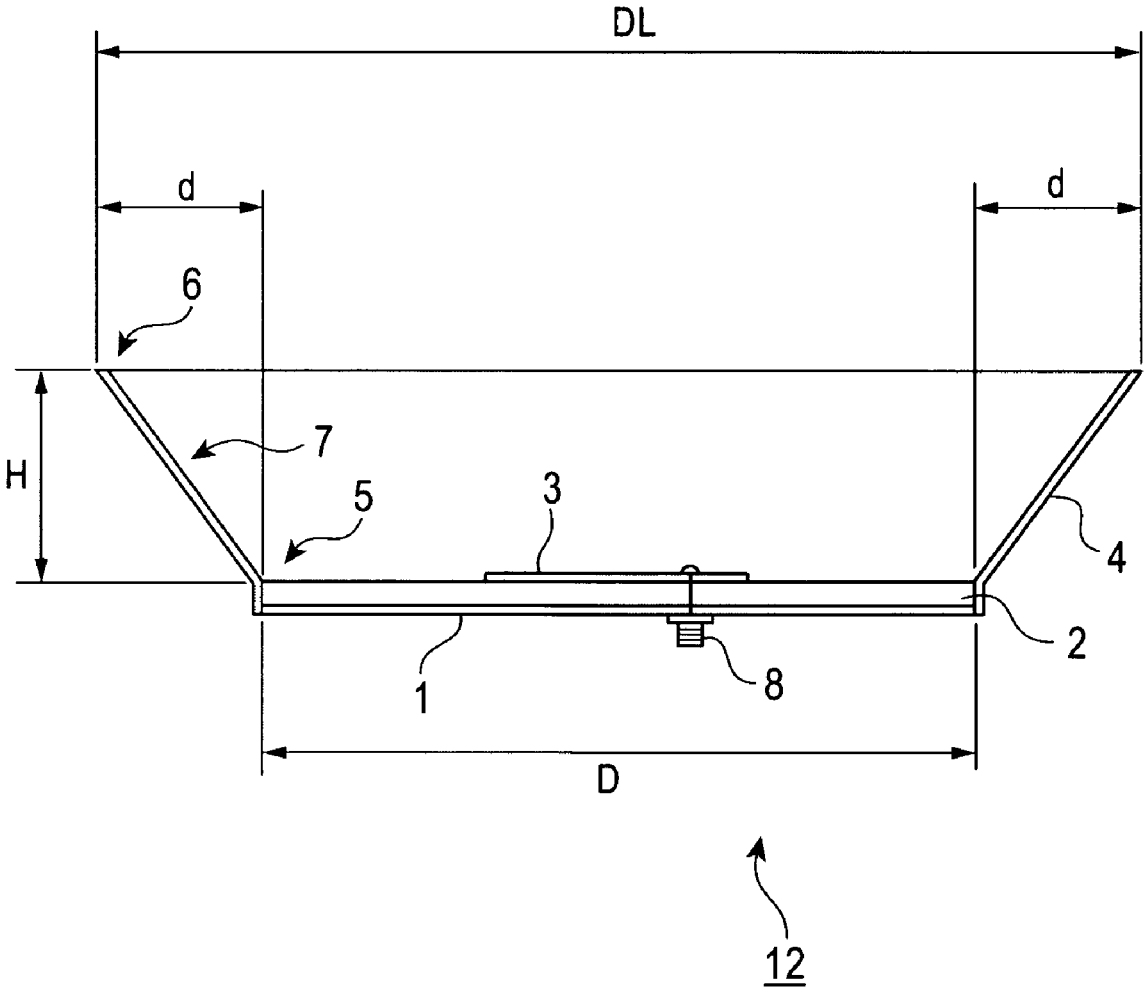
FIG. 1 is a vertical sectional view of an antenna device of the present invention.

1 metal plate as a ground plate
2 dielectric substrate as a substrate
3 metal plate as a microstrip patch
4 conical cup as a conductive member
5 lower opening portion

6 upper opening portion
7 side wall portion of a conductive member
8 feed connector
9 honeycomb material
10 parasitic microstrip patch
11 substrate for a parasitic microstrip patch
12 antenna device of the present invention

BEST MODE FOR CARRYING OUT THE INVENTION

An embodiment of the present invention is described in detail with reference to FIGS. 1 and 2. Moreover, the present invention is not limited to the following description, but the designing can be appropriately changed.

In a best mode for carrying out the invention as in the following, a high gain and a narrower beam width are compatible. Not only an antenna device of the present invention, but also an antenna device in a best mode for carrying out is required to have performance for desired purposes of the antenna device. For example, there are cases where the increase of gain or the decrease of a beam width is required. There are also opposite cases to those. Accordingly, an embodiment shown below is not always a best mode. In this connection, the purpose of using the antenna device of the embodiment shown below is the use for satellite communication, that is, the increase of gain in order to increase a link margin.

Figure 2:
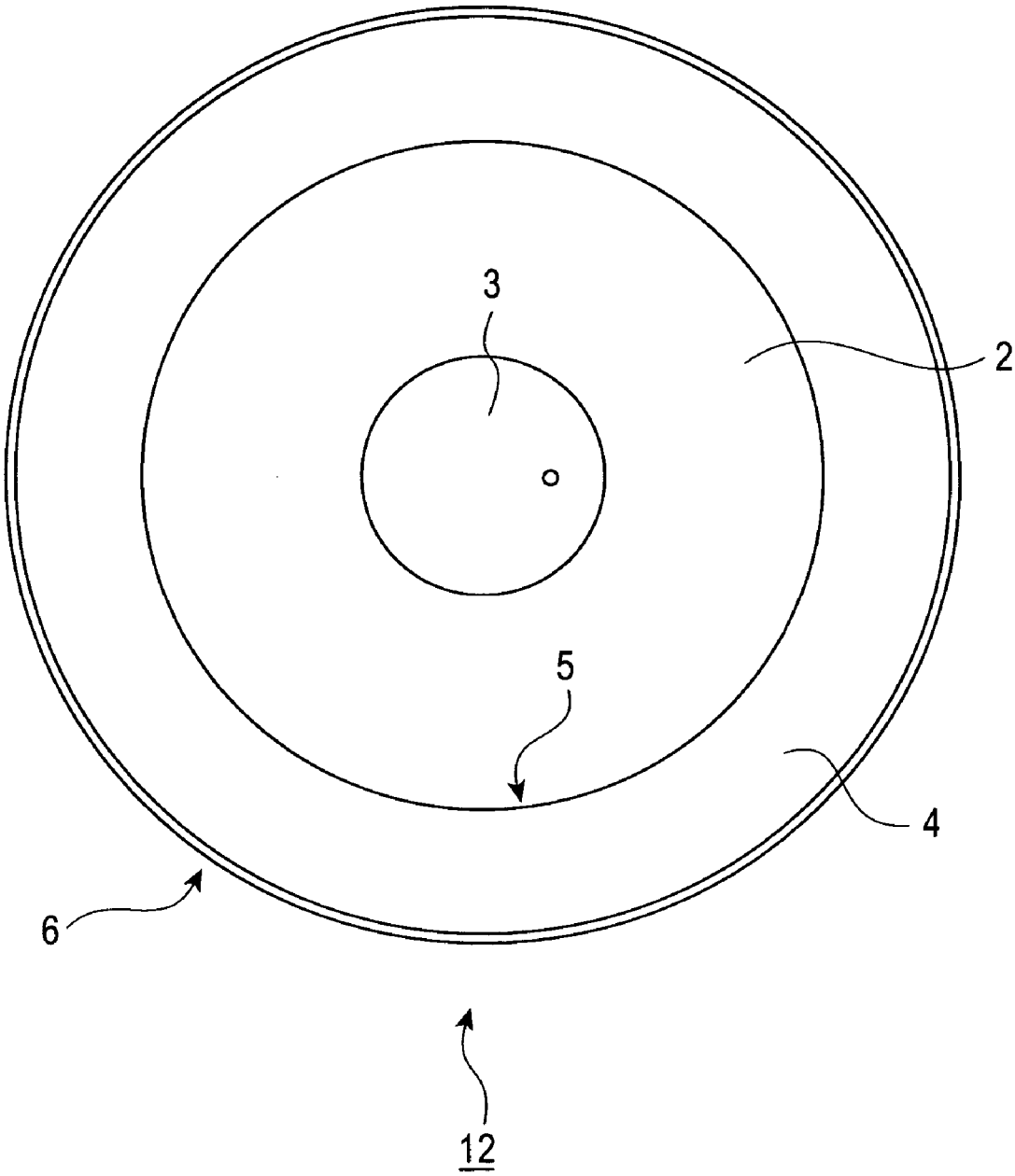
FIG. 2 is a top view of the antenna device of the present invention.

A vertical sectional view of an antenna device of the present invention is shown in FIG. 1 and a top view of the antenna device of the present invention is shown in FIG. 2.

The shape of a metal plate (1) serving as a ground plate, a dielectric substrate (2) as a substrate, and a metal plate (3) as a microstrip patch is circular, respectively. The shape of the metal plate (1), the dielectric substrate (2) or the metal plate (3) may be a quasi circular.

The metal plate (1) as a ground plate and the dielectric substrate (2) generally have the same size and the same shape, but they must not have the same size and the same shape. For example, the metal plate (1) as a ground plate may be made a square form containing the dielectric substrate (2) therein. In the present embodiment, the metal plate (1) as a ground plate and the dielectric substrate (2) have the same size and shape.

Generally, the radius of the metal plate (3) as a circular microstrip patch can be approximately obtained with the following formula (hereinafter, referred to as formula 1).

$$F=1.841\times C/[2\pi\{a+2(t/\pi)1n2\}\sqrt{\epsilon_r}]$$

Here, F is the resonance frequency, that is, the frequency of a signal wave as a target of an antenna device of the present invention, C is the light velocity, a is the radius of a circular microstrip patch, t is the thickness of the substrate, and $\in_r$ is the dielectric constant of the substrate.

Furthermore, the wavelength λ of a signal wave as a target of an antenna device of the present invention can be obtained with the following formula (referred to as formula 2)

$$\lambda=C/F$$

Hereinafter, a wavelength represents the wavelength λ of a signal wave as an object of an antenna device (12) of the present invention.

The diameter of the metal plate (1) as a ground plate and the dielectric substrate (2), that is, the portion represented by D in FIG. 1 is about one wavelength long.

Although it is desirable that the metal plate is a metal having a low electric resistance, usually a relatively low-priced copper of a sufficiently low electric resistance is used. Furthermore, different metals may be used for the metal plate (1) as a ground plate and the metal plate (3) as a microstrip patch, but normally the same metal is used.

Figure 3:
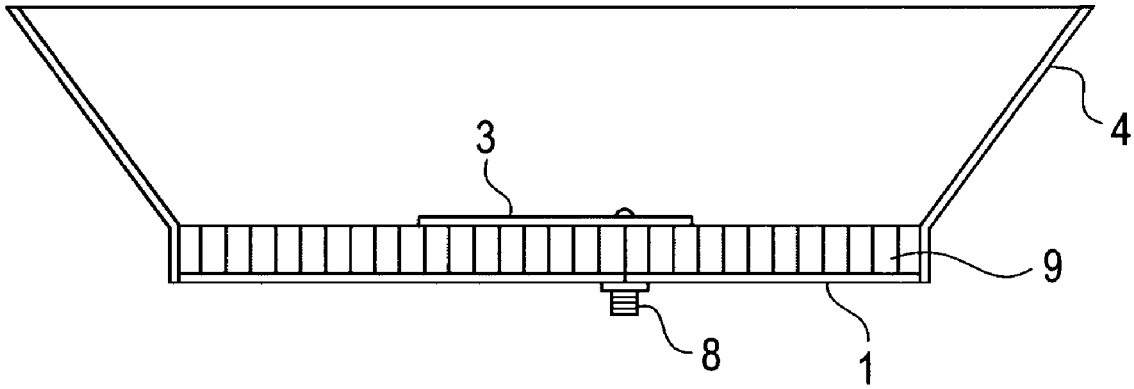
FIG. 3 is a vertical sectional view of an antenna device in which the substrate is made of a honeycomb material.

As a dielectric substrate, there are a glass epoxy resin, polyethylene resin, ceramic dielectric material, etc., but publicly known dielectric materials for the microstrip antenna in the past may be used. Furthermore, as shown in FIG. 3, the dielectric substrate (2) may be formed by using a honeycomb material (9). In this way, a broadband antenna device can be realized.

The metal plate (1) as a ground plate and the dielectric substrate (2) are glued so as to be in agreement with each other, and the metal plate (3) as a microstrip patch is normally glued in the middle portion of the dielectric substrate (2) such that the metal plate (3) does not protrude from the dielectric substrate (2).

Regarding a method of gluing, although there is a method using a so-called adhesive, since the dielectric constant is changed by the adhesive, an etching process is performed on the metal plates used as a ground plate and a microstrip patch, and a method for removing a part of the metal plate as a microstrip patch is used. As a result, the same effect can be obtained as in the case where the metal plates as a ground plate and a microstrip plate are glued on the dielectric substrate (2). Furthermore, according to the method of performing an etching process, the portion of the metal left after the removal functions as a microstrip patch and, since the resonance frequency is controlled by the size of the microstrip patch, the resonance frequency can be set such that the portion to be removed of the metal plate is adjusted. Moreover, since a method for gluing the dielectric substrate to the metal plate as a ground plate and the microstrip patch is not an essential part of the present invention, the above method is not necessarily required, and any publicly known method in the past may be appropriately used.

A conical cup (4) which is a substantially conical conductive member having both upper and lower sides made open is formed by using a metal. Regarding the material, although the use of a material different from the metal plate (1) as a ground plate and the metal plate (3) as a microstrip patch is not excluded, in order to avoid the affect due to inherent impedances depending on each kind of metals when the different metals are used, normally the same materials are used. In the present embodiment, the material of copper is used.

The lower opening portion (5) of the conical cup (4) is circular, the diameter is substantially the same as that of the dielectric substrate (2) and the metal plate (1) as a ground plate, and the opening portion (5) is made in contact with the surrounding edge portion of the dielectric substrate (2) and the metal plate (1) as a ground plate. However, the conical cup (4) is not necessarily required to be made in contact with the dielectric substrate (2), and it is enough that at least the conical cup (4) is made in contact with the metal plate (1) as a ground plate. As the contact method, for example, a welding method by soldering may be used. In this way, while being grounded to the metal plate (1) as a ground plate, the conical cup (4) is vertically erected around the metal plate (3) as a microstrip patch.

The gradient of a side wall portion (7) as the ring-shaped body of the conical cup (4) is normally substantially constant.

Furthermore, the upper opening portion (6) opposite to the dielectric substrate (2) of the conical cup (4) is circular, and the diameter, that is, the portion represented by DL in FIG. 1 is about 3/2 a wavelength. The height of the conical cup (4), that is, the portion represented by H in FIG. 1 is about 1/3 a wavelength.

Figure 4:
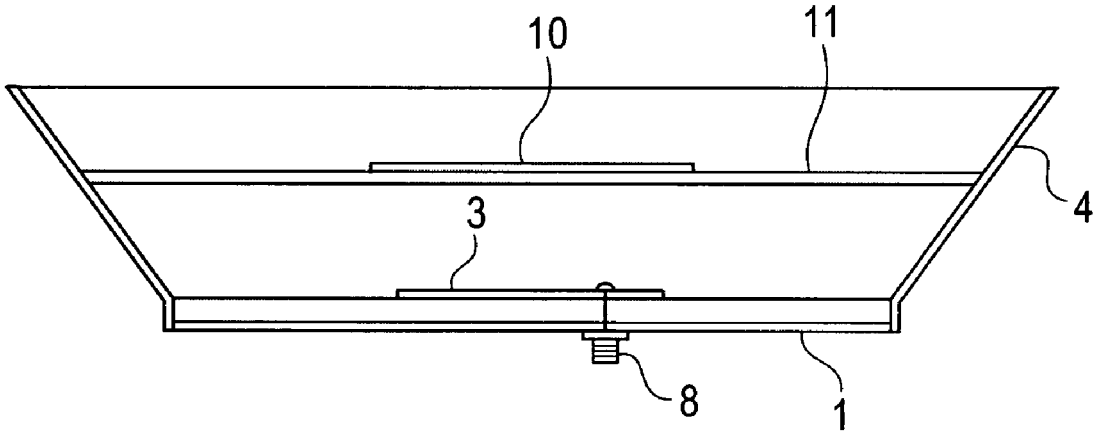
FIG. 4 is a vertical sectional view of an antenna device in which a parasitic microstrip patch is provided.

As shown in FIG. 4, a parasitic microstrip patch (10) and a substrate (11) for the parasitic microstrip patch may be provided in the front of the radiation surface of the microstrip patch. In such a way, a broadband antenna device can be realized. Or the dielectric substrate (2) is formed by using a honeycomb material (9) and, in addition to that, a parasitic microstrip patch (10) and a substrate (11) for the parasitic microstrip patch may be provided in the front of the radiation surface of the microstrip patch.

Regarding a method for feeding the antenna device (12), a publicly known method in the past may be used. In the methods for feeding the antenna device shown in FIGS. 1, 3, and 4, a pin-type feeder in which a feeding connector (8) is provided in the metal plate (1) as a ground plate is provided is used.

Next, in addition to the above embodiments, the result of numerical computation conducted by the present inventor et al. is briefly mentioned.

An embodiment for which numerical computation was conducted is as follows.

The frequency of a signal wave as an object of the antenna device (12) is set to be 2.5 GHz, and a PTFE dielectric material having a dielectric constant of 2.17 and a thickness of 1.524 mm is used.

Based on the above formula 2, the wavelength of a signal wave as an object for transmission and reception of the antenna device becomes 120 mm. Furthermore, by using the above formula 1, the radius of the microstrip patch was calculated and set to be 46 mm (23/60 a wavelength). A copper material was used for the microstrip patch, ground plate, and conical cup. The thickness of the conical cup was set to be 0.2 mm.

Figure 5:
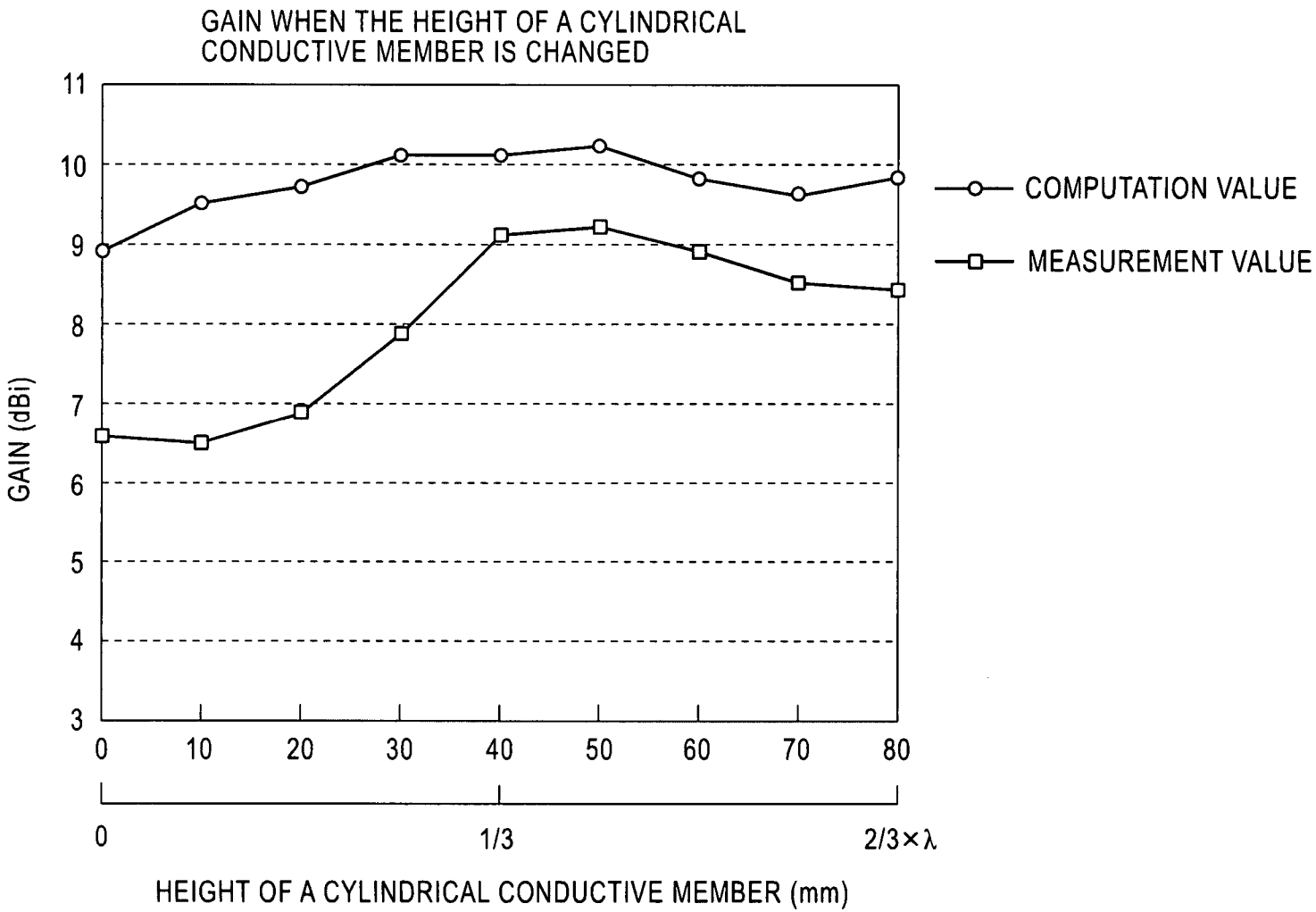
FIG. 5 shows the change of gain to the height of a cylinder cup when the cylinder cup of a substantially cylindrical conductive member is provided around a microstrip antenna.

In FIG. 5, a table showing the change of gain to the height of a cylinder cup when the cylinder cup of a substantially cylindrical conductive member is provided around the microstrip antenna is shown. From the computation values and measurement values in FIG. 5, it was understood that high gains can be obtained in the range where the height of the cylinder cup is from about 40 mm (about 1/3 a wavelength) to about 60 mm (1/2 a wavelength). Accordingly, it is found that it is desirable that, when a conical cup is provided, in order to obtain a high gain, the height of the conical cup is set to be from about 40 mm (1/3 a wavelength) to about 60 mm) 1/2 a wavelength) in the same way as in the case where the cylinder cup is provided.

Then, for convenience of numerical computation, the height of the conical cup is fixed at 40 mm (1/3 a wavelength) and, when the diameter and spread diameter of the substrate (as an indicator showing the degree of expansion of the upper opening portion of the conical cup, a half of the difference between the diameter of the ground plate and the dielectric substrate and the diameter of the upper opening portion, that is, the portion represented by d in FIG. 1 is defined as a spread diameter of the substrate) are changed, the change of gain (computation value) is shown in FIG. 6. Furthermore, in the same way, the height of the conical cup is fixed at 40 mm (1/3 a wavelength) and, when the diameter and spread diameter of the substrate is changed, the change of a beam width (computation value) is shown in FIG. 7. In FIGS. 6 and 7, the diameter of the substrate is changed from 80 mm (2/3 a wavelength) to 150 mm (5/4 a wavelength) and the spread diameter is changed from zero mm (zero a wavelength) to 50 mm (5/12 a wavelength). However, the changes are not limited to those and shown only as examples. From these figures, it is understood that the improvement of gain and/or the attainment of a narrow beam width is practicable such that a substantially conical conductive material is provided around the microstrip patch. Then, an antenna device having a gain and beam width for desired purposes can be constituted such that the diameter of the substrate and the spread diameter are properly combined. Moreover, even if various wavelength areas are used without limiting to the present embodiment, the same effect can be obtained.

Figure 8:
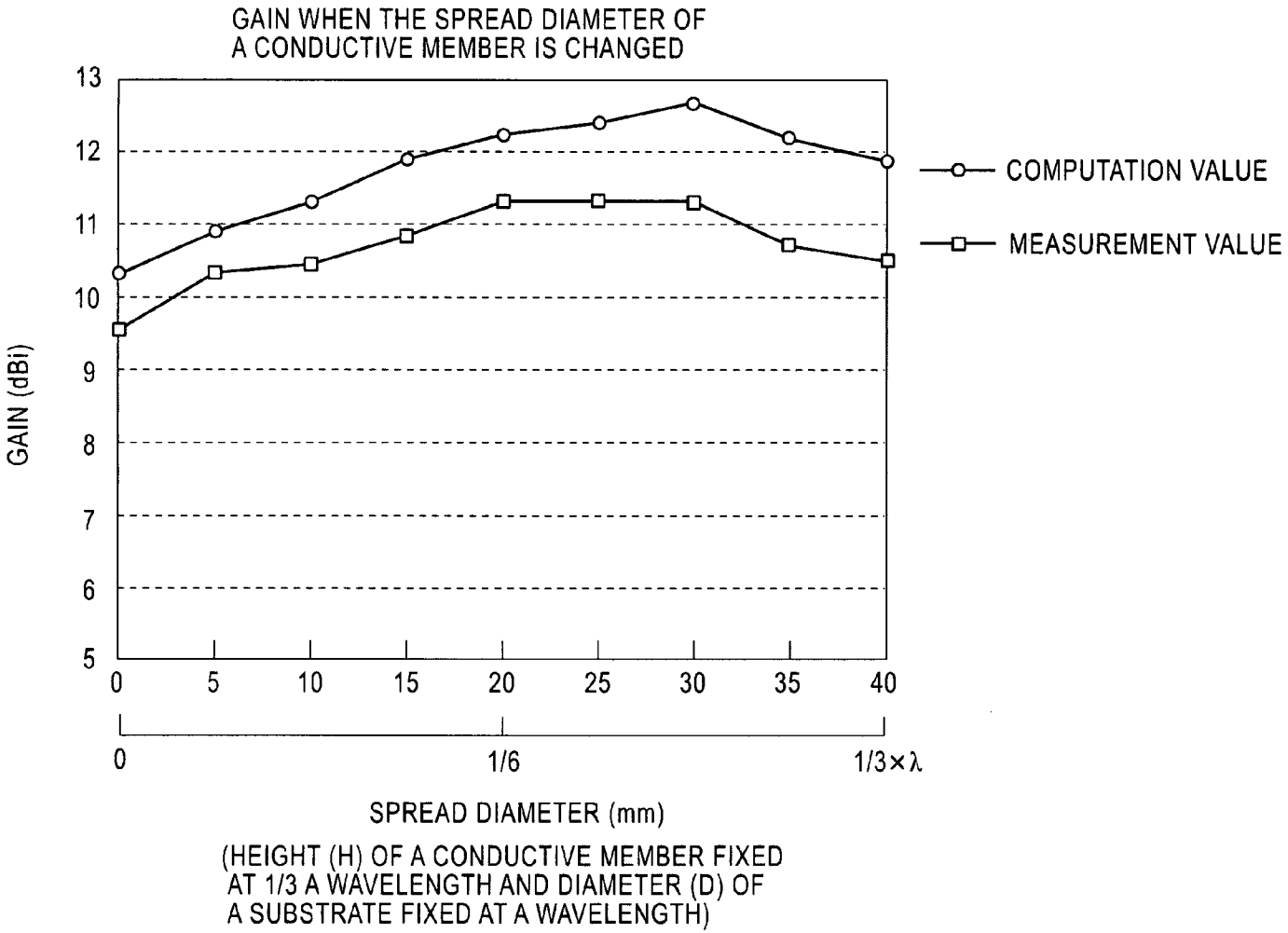
FIG. 8 shows the change of gain (measurement value) when the diameter of the upper opening portion of a substantially cylindrical conductive member is changed while the height of the conductive member is fixed at ⅓ a wavelength and the diameter of a substrate is fixed at a wavelength.
Figure 9:
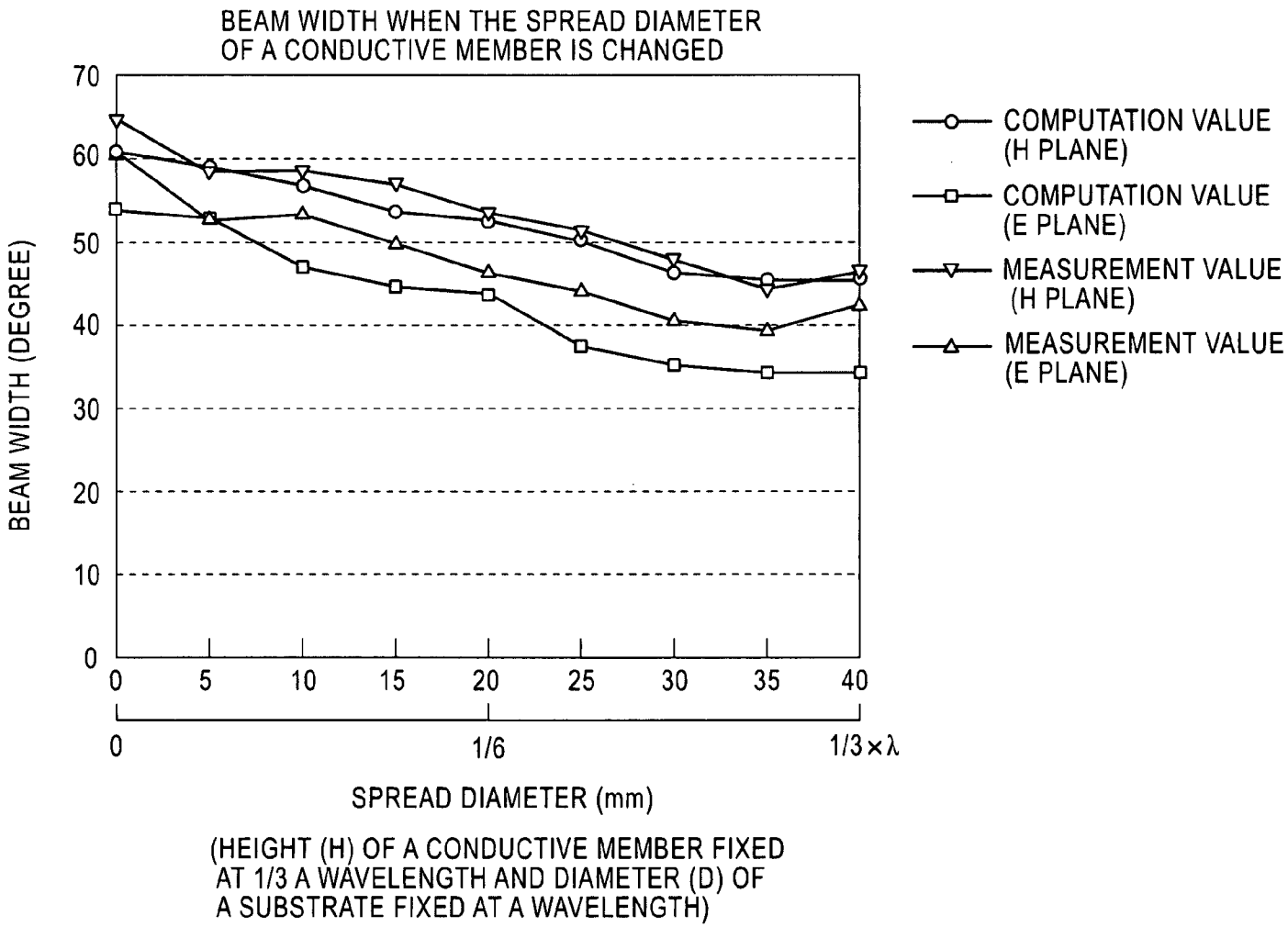
FIG. 9 shows the change of a beam width (measurement value) in the H and E planes when the diameter of the upper opening portion of a substantially cylindrical conductive member is changed while the height of the conductive member is fixed at ⅓ a wavelength and the diameter of a substrate is fixed at a wavelength.

Furthermore, the present inventor et al. practically took measurement of the gain and beam width of a part of the objects of the above numerical computation, and the result of the measurement is shown. Concretely, while the height of the conical cup is set at 40 mm (1/3 a wavelength) and the diameter of the dielectric substrate is set at 120 mm (one wave length), the change of gain (measurement value) when the spread diameter is changed is shown in FIG. 8. Furthermore, while the height of the conical cup is set at 40 mm (1/3 a wavelength) and the diameter of the dielectric substrate is set at 120 mm (one wave length), when the spread diameter is changed, the change of a beam width (measurement value) in the H plane (the plane containing the magnetic-field vector of an electromagnetic wave) and the E plane (the plane containing the electric-field vector of an electromagnetic wave) of the antenna pattern is shown in FIG. 9. As shown in these figures, although there is some difference between the computation values and the measurement values, a similarity can be seen between the tendencies of change of the computation values and the measurement values for the gain and the beam width when the spread diameter is changed. Therefore, not only in the numerical computation, but also practically, the improvement of gain and/or the attainment of a narrow beam width was confirmed such that a substantially conical conductive member is provided around the microstrip patch.

Furthermore, without changing the metal plate (1) as a ground plate, the dielectric substrate (2), and the metal plate (3) as a microstrip patch, an antenna device having a gain and beam width for desired purposes can be constituted by changing the height of the conductive member or the diameter of the upper opening of the conductive member.

INDUSTRIAL APPLICABILITY

According to the present invention, an antenna device having a gain and beam width for desired purposes can be constituted such that a conductive member of a combination of an appropriate diameter of a substrate and a spread diameter is provided around a microstrip patch. Furthermore, an antenna device having a high gain and narrow beam width which are consistent with each other can be constituted, although dependent on a combination of the diameter of a substrate and the spread diameter. Moreover, an antenna device of the present invention is also characterized by being small and light in the same way as a microstrip antenna is.

Therefore, for example, the antenna device can be used as a primary radiator of a reflector antenna. Furthermore, it is also able to consider applications of a mobile station antenna, portable station antenna, satellite-mounted antenna, or a primary radiator for these, and, as a result, an antenna device of the present invention can be utilized in a wide range of fields in the industry.

The invention claimed is:

1. An antenna device comprising:

a substantially circular substrate;

a substantially circular microstrip patch provided on the upper surface of the substrate; and a substantially cylindrical conductive member having upper and lower opening portions erected in a substantially vertical direction around the microstrip patch, wherein the lower opening portion of the conductive member is grounded to a ground plate provided on the lower side of the substrate, wherein the diameter of the upper opening portion of the conductive member is larger than the diameter of the lower opening portion of the conductive member, and wherein, to a wavelength of a signal wave serving as an object of an antenna device, the height of the conductive member is from about ⅓ to about ½ a wavelength and the diameter of the substrate is from about ¾ to about ⁵⁄₄ a wavelength.

2. An antenna device as claimed in claim 1, wherein, to a wavelength of a signal wave serving as an object of an antenna device, the height of the conductive member is about ⅓ a wavelength, and the diameter of the upper opening portion of the conductive member is from about ¹³⁄₁₂ a wavelength to about ¹¹⁄₆ a wavelength.

3. An antenna device as claimed in claim 1, wherein, to a wavelength of a signal wave serving as an object of an antenna device, the height of the conductive member is about ⅓ a wavelength, the diameter of the substrate is about a wavelength, and the diameter of the upper opening portion of the conductive member is about ³⁄₂ a wavelength.

4. An antenna device as claimed in claim 1, claim 2 or claim 3, wherein the substrate is made up of a honeycomb material.

5. An antenna device as claimed in claim 1, wherein a parasitic microstrip patch is provided in the front of the radiation surface of the microstrip patch.

6. An antenna device as claimed in claim 1, wherein the device can design a gain and beam width by changing the height of the conductive member or the diameter of the upper opening of the conductive member.

* * * * *